United States Patent [19]

Aberer

[11] 4,053,981

[45] Oct. 18, 1977

[54] POWER OPERATED CAN OPENER HAVING AUTOMATIC SHUTOFF MEANS, A REMOVABLE HAND LEVER ASSEMBLY, AND A MANUAL CRANK

[75] Inventor: James B. Aberer, Lake Winnebago, Mo.

[73] Assignee: Rival Manufacturing Company, Kansas City, Mo.

[21] Appl. No.: 677,501

[22] Filed: Apr. 15, 1976

[51] Int. Cl.[2] ..... B67B 7/38

[52] U.S. Cl. ..... 30/419; 30/421; 30/424; 30/426

[58] Field of Search ..... 30/4 R, 8, 8.5, 9, 419, 30/420, 421, 423–427

[56] References Cited

U.S. PATENT DOCUMENTS

| | | | |
|---|---|---|---|
| 2,794,245 | 6/1957 | Gundelfinger | 30/4 R |
| 3,688,400 | 9/1972 | Aberer | 30/4 R |
| 3,733,698 | 5/1973 | Yamamoto | 30/4 R |
| 3,818,589 | 6/1974 | Oberto | 30/4 R |
| 3,949,468 | 4/1976 | McLean | 30/4 R |

*Primary Examiner*—Gary L. Smith
*Attorney, Agent, or Firm*—Lowe, Kokjer, Kircher, Wharton & Bowman

[57] ABSTRACT

A motor driven can opener includes a pivotal hand lever assembly which may be removed from the can opener frame. A latch on the frame engages an edge portion of the hand lever to retain the lever on the frame throughout its normal operating range. A plate on which a can cutting element is carried is mounted to slide on the forward surface of the lever. A tab projects from the plate and catches on a hardened steel pin of the frame to hold the hand lever against the actuator of a rotary switch which maintains the motor in its energized condition during shearing of a can lid. When the can shearing is completed, the tab releases from the pin to automatically deenergize the motor.

A manual crank may be employed as an alternative to electrical power. The motor is removed from the drive train when the crank is employed and brought back into the drive train when the crank is removed.

22 Claims, 9 Drawing Figures

Fig. 6.
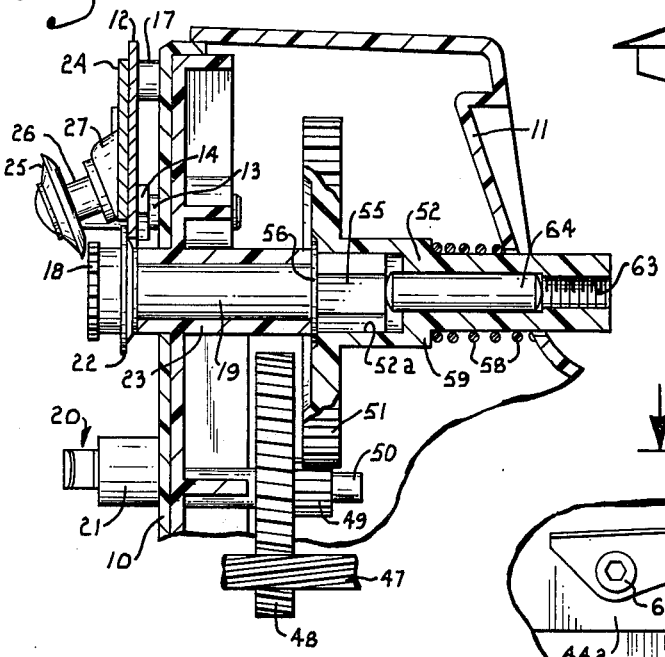
Fig. 9.
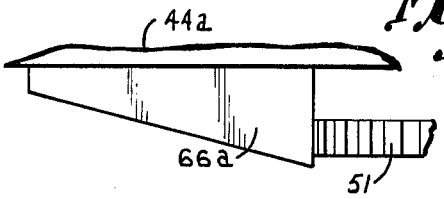
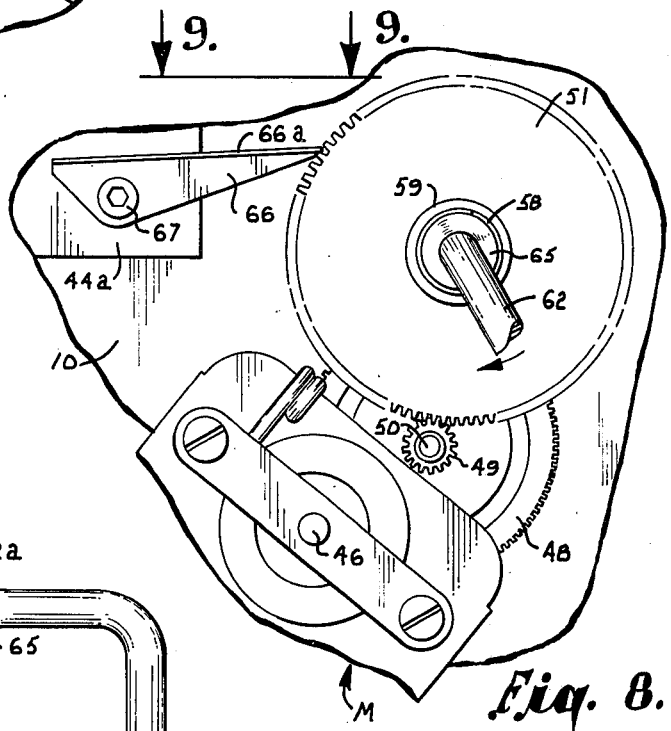
Fig. 8.
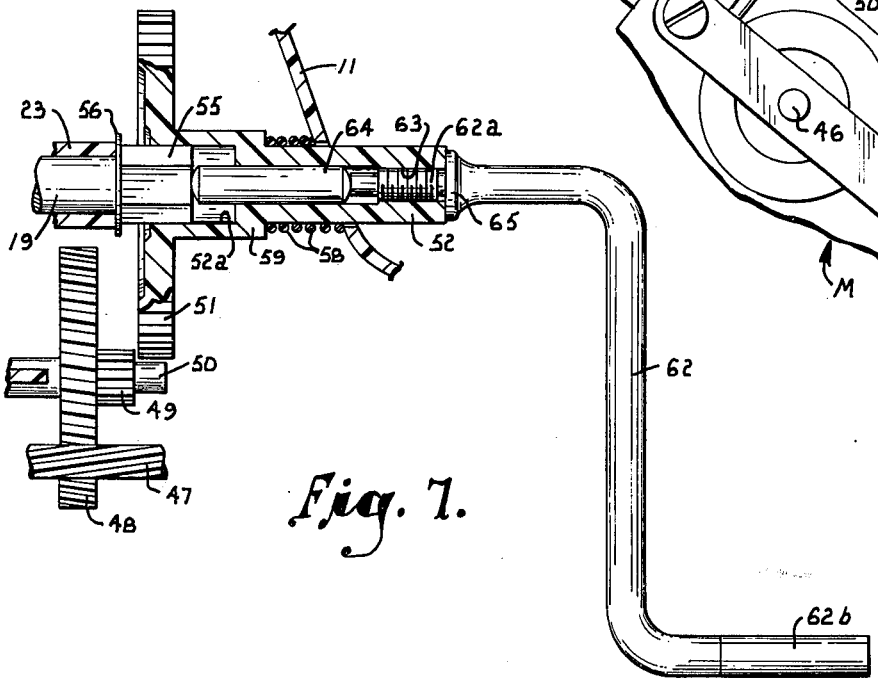
Fig. 7.

POWER OPERATED CAN OPENER HAVING AUTOMATIC SHUTOFF MEANS, A REMOVABLE HAND LEVER ASSEMBLY, AND A MANUAL CRANK

BACKGROUND AND SUMMARY OF THE INVENTION

This invention relates generally to can openers and more specifically to power operated can openers of the type which remain on during shearing of a can lid and which shut off automatically on completion of the can shearing.

This type of can opener has proven to have significant practical advantages, particularly in reducing the inconvenience to the user. However, for the most part, existing can openers of this type are complex and expensive to construct, and the shut off mechanisms do not operate reliably, especially after prolonged usage. In addition, the switches employed in the prior art can openers are not altogether effective in achieving power pierce of the can lid as easily as possible.

The present invention is also concerned with an improved latching mechanism which pivotally mounts the hand lever on the frame while at the same time permitting easy removal of the lever for cleaning and other purposes. A can opener with a latching mechanism that releases upon movement of the hand lever to a position beyond its normal pivot arc is disclosed in U.S. Pat. No. 3,688,400. This type of latch has proven relatively successful on the whole, although problems sometimes develop due to lever wobble as it is pivoted. This wobble occurs because the latch plate is located rearwardly of the hand lever in a plane offset from that of the lever, thereby enabling the latch plate to move relative to the lever.

The subject invention further contemplates the provision of an electrically powered can opener which may be driven manually in situations where an electrical outlet is unavailable. Conventional electric can openers operate only by means of electrical power and are incapable of opening cans unless an electrical power source is available. In the present invention, this drawback is eliminated because the can opener is able to be operated by a manual crank as an alternative to being electrically driven.

It is an object of this invention to provide a power operated can opener which includes a simple, effective and economical means for maintaining the motor in its energized condition as a can lid is being sheared and for automatically deenergizing the motor when the can shearing has been completed.

Another object of the invention is to provide a can opener of the character described which utilizes the operating thrust to maintain the motor energized during shearing of a can end. Accordingly, automatic shut off is effected when the can shearing is completed and the operating thrust is no longer present.

In conjunction with the preceding object, a still further object of the invention is to provide, in a can opener of the character described, a cutter mounting plate which is able to slide relative to the hand lever in order to effect automatic shut off of the motor. The cutter mounting plate includes a tab projection which engages a catch on the frame with greater lateral force than upward force during can shearing to retain the lever against the motor switch. However, after completion of the can shearing, the upward force is greater than the lateral force and the cutter mounting plate is able to slide in order to release the tab from the catch and thereby deenergize the motor.

A further object of the invention is to provide a can opener of the character described in which a camming surface is formed on the catch in order to properly position the tab projection relative thereto.

Still another object of the invention is to provide a can opener of the character described which includes an improved rotary type switch for energizing and deenergizing the motor, the switch achieving easier power pierce of a can lid as compared to switches heretofore used in can openers.

An additional object of the invention is to provide a can opener having a simple and reliable latching mechanism which retains the hand lever on the can opener frame and yet permits quick and easy removal of the lever therefrom. Any tendency of the lever to wobble as it is pivoted on the frame is eliminated due to the engagement of a portion of the hand lever itself by the latch.

Yet another object of the invention is to provide a can opener which may be driven either with electrical power or with a manual crank.

A still further object of the invention is to provide, in a can opener of the type described in the preceding object, means for disengaging the motor from the drive train when the crank is employed and for returning same to the drive train when the crank is removed.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals are employed to indicate like parts in the various views:

FIG. 6 is a fragmentary side sectional view taken through the can opener;

FIG. 7 is a fragmentary sectional view similar to FIG. 5, but with portions of the can opener removed for clarity and the manual crank operatively installed on the can opener;

FIG. 8 is a fragmentary rear elevational view with the casing removed to illustrate the internal components of the can opener, and FIG. 9 is a fragmentary plan view taken generally along line 9—9 of FIG. 8 in the direction of the arrows.

Figure 1:
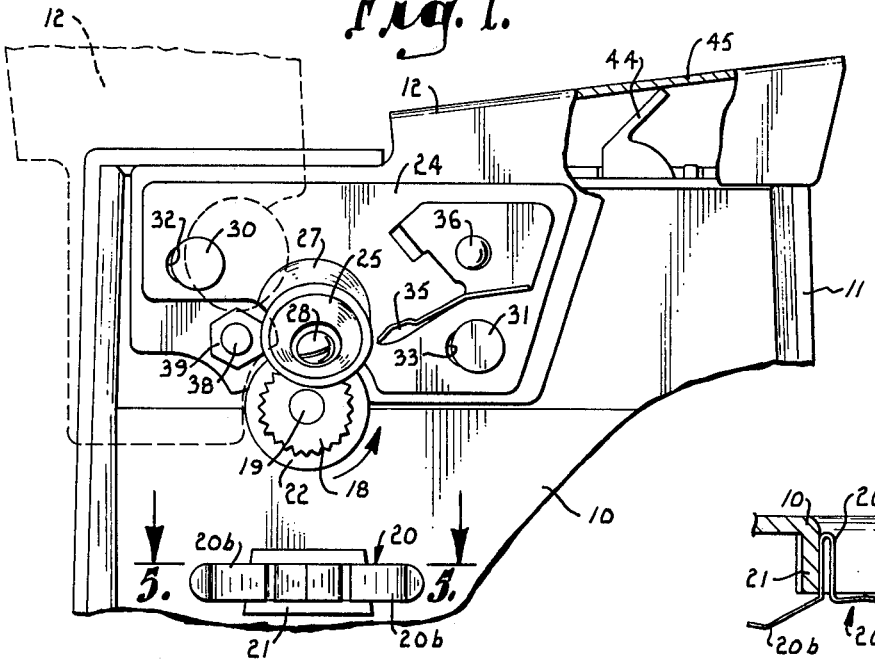
FIG. 1 is a front elevational view of the upper portion of a can opener constructed according to the invention, with a portion of the hand lever broken away to illustrate the plunger switch and the broken lines indicating movement of the lever to a position permitting its removal from the frame.

Referring now to the drawings in detail, the upright front panel or frame of the can opener is designated by reference numeral 10. Frame 10 cooperates with a box-like casing 11 to support and house the operating components of the can opener.

Figure 2:
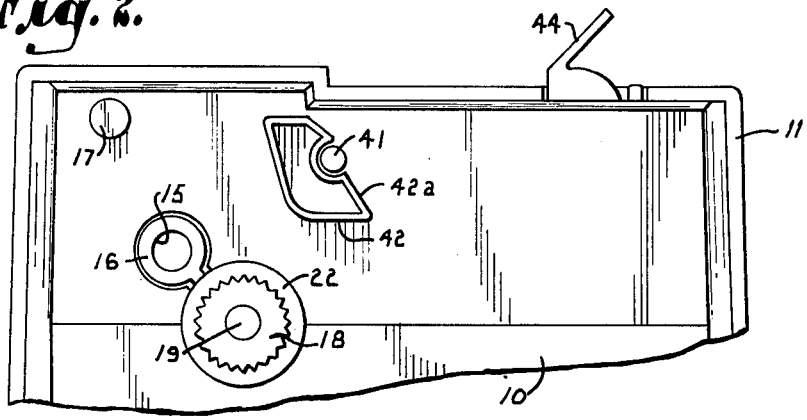
FIG. 2 is a fragmentary front elevational view similar to FIG. 1, but with the hand lever assembly removed from the frame.

A hand lever 12 is mounted for pivotal movement on the forward surface of frame 10. Cylindrical pin 13 (FIG. 3) extends rearwardly from lever 12, same being affixed thereto by threading a nut 14 onto pin 13 and against lever 12. Pin 13 is inserted in a bore 15 (FIG. 2) formed in frame 10 to pivotally mount lever 12 on the frame. An annular boss 16 is circumscribed around bore 15 on frame 10 to space lever 12 slightly forwardly of the frame. Another boss 17 on the frame cooperates with boss 16 to maintain the spacing of lever 12 and to facilitate the pivotal movement thereof.

Serrated can feed wheel 18 is mounted on a shaft 19 in order to be rotatively driven on the forward surface of the frame. Can rest 20 (FIGS. 1 and 5) projects forwardly from frame 10 at a location below feed wheel 18 and serves to maintain the side wall of a can at the proper angle relative to the feed wheel.

Figure 5:
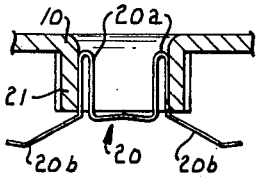
FIG. 5 is a fragmentary view taken partially in cross section generally along line 5—5 of FIG. 1 in the direction of the arrows.

As best shown in FIG. 5, can rest 20 is mounted to a boss 21 of frame 10. A pair of spaced apart bent portions **20*a* of the can rest are tightly inserted within a hollow central portion of boss 21 to press outwardly against the internal boss walls and thereby retain the can guide on the frame. Can guide 20 includes opposite projecting arm portions 20*b* which extend outwardly from frame 10 and away from one another at an angle. Arm portions 20*b* engage the side of an inserted can to prevent it from tipping and possibly spilling its contents as feed wheel 18** coasts to a stop.

With particular reference to FIG. 6, it may be clearly seen that a latch 22 is installed on shaft 19 at a location rearwardly of feed wheel 18. This latch 22 is in the form of a cup shaped washer having a dished forward surface with a circular periphery and a substantially flat surface near the periphery. The flat peripheral surface of latch 22 is spaced slightly forwardly of the forward surface of boss 23 with same being substantially parallel to the frame.

Figure 3:
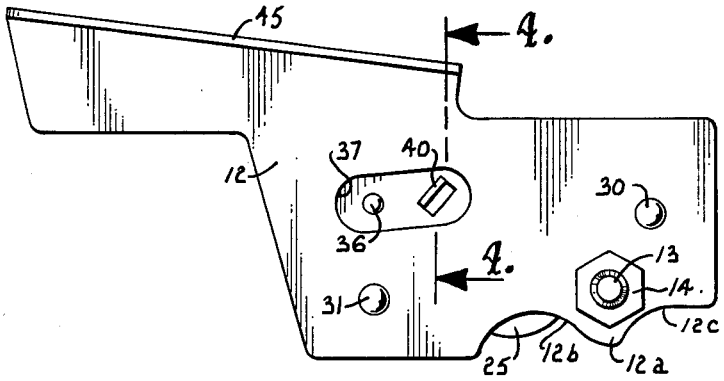
FIG. 3 is a rear elevational view of the hand lever detached from the frame.

As shown in FIG. 3, the under edge of lever 12 is contoured in the area below pin 13 and forms a projection **12*a*. Curved recesses 12*b* and 12*c* are defined in lever 12 on opposite sides of projection 12*a*. The recessed edge of recess 12*c* is arcuate in shape to correspond with the peripheral edge of latch 22. When lever 12 is mounted on the frame, the contoured under edge of the lever fits between the frame and the peripheral surface portion of latch 22, the latch thereby preventing withdrawal of pin 13 from bore 15. Since lever 12 itself is engaged by latch 22,** lever wobble, as known in existing latching arrangements where a latch plate or the like is mounted in a plane offset from that of the lever, is precluded.

As lever 12 is pivoted on frame 10, the projection **12*a* remains engaged behind latch 22 during movement of the lever from a horizontal position to almost a vertical position. However, when the lever is pivoted completely upwardly to the vertical position shown in broken lines in FIG. 1 (which position is beyond the normal operating range of the lever), projection 12*a* clears the edge of latch 22 and recess 12*c* is positioned around the edge of the latch. The arcuate edge of recess 12*c* is able to clear the edge of latch 22 as lever 12 is pulled forwardly to withdraw pin 13 from bore 15 and thereby remove the lever for cleaning or other purposes. Reinstallation of the lever may be achieved by orienting it vertically and pushing it toward the frame so that pin 13 enters bore 15. After recess 12*c* has cleared the edge of latch 22, downward pivoting of lever 12 positions projection 12*a* behind latch 22** to retain the lever on the frame throughout its operating pivot arc.

A cutter mounting plate 24 is mounted on the forward surface of lever 12 for limited sliding movement thereon. Referring to FIGS. 1 and 5, a cutter wheel 25 is mounted for limited wobble movement on a stud or arbor 26 which is anchored to a compound angled boss 27 on plate 24. A screw 28 secures cutter wheel 25 on stud 26.

A pair of shoulder rivets 30 and 31 are anchored to extend forwardly of lever 12. Rivets 30 and 31 extend through elliptical slots or openings 32 and 33, respectively, that are formed through plate 24 near the upper left hand corner and the lower right hand corner thereof. Rivets 30 and 31 have enlarged heads which contact the forward surface of plate 24 to maintain the plate against the forward surface of lever 12. The major axes of openings 32 and 33 are oriented horizontally to permit plate 24 to slide horizontally on lever 12. Engagement of rivets 30 and 31 with the side edges of openings 32 and 33 limits the sliding movement of plate 24 relative to lever 12.

Resilient can guide 35 is secured to plate 24 by rivet 36 and projects forwardly therefrom. The head of rivet 36 is received in a horizontally oriented slot 37 (FIG. 3) formed in lever 12 in order to accommodate relative movement between plate 24 and lever 12. The left end (FIG. 1) of can guide 35 is a free end which acts in the manner of a spring that bears downwardly against the rim of an inserted can in order to hold the rim or flange of the can firmly on top of feed wheel 18.

On the opposite side of cutter wheel 25 from can guide 35, a fixed cylindrical can guide 38 extends forwardly from lever 12. Can guide 38 is a forward coaxial extension of pin 13 and is secured on lever 12 by a nut 39. Fixed can guide 38 likewise acts against the top or rim of a can to maintain it firmly on feed wheel 18.

Figure 4:
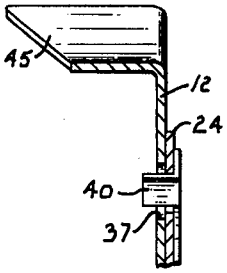
FIG. 4 is a cross sectional view taken through the hand lever assembly generally along line 4—4 of FIG. 3 in the direction of the arrows.

An ear or tab 40 (FIGS. 3 and 4) is turned rearwardly from the can guide assembly 35 at a location to the right of cutter wheel 25 (as viewed in FIG. 1). Tab 40 projects rearwardly through slot 37 which is much greater in size than tab 40 to accommodate horizontal movement of plate 24 on lever 12.

Tab 40 is engageable with a hardened steel pin 41 (FIG. 2) which is installed in frame 10 at the right edge portion of a boss 42. This engagement of tab 40 with pin 41 retains the can opener motor on during shearing of a can lid, as will be explained in more detail. Box 42 is irregularly shaped and includes an inclined right edge along which pin 41 is located, with the round surface of the pin projecting beyond the inclined edge portion of the boss. Below pin 41, the inclined boss surface **42*a* serves as a stop surface against which tab 40 bears (along with the underside of pin 41**) during the shearing of a can lid.

A rotary switch actuator 44 extends through an opening in the top of casing 11 and is a portion of a normally open rotary type switch for an electric motor M (FIG. 7) which drives feed wheel 18. The switch mechanism is contained in a switch housing **44*a* (FIG. 8) which is mounted to the back of frame 10. Actuator 44 is biased upwardly to normally maintain the switch contacts (not shown) apart so that the switch is open and the motor is in a deenergized condition. When actuator 44 is depressed, the switch contacts close and the motor M is energized. Lever 12 is provided with a rearwardly turned flange 45 (FIG. 1) which depresses actuator 44 when the lever is swung completely downwardly to shear a can lid. The rotary switch and actuator 44 are advantageous because the rotary action and the relatively great height to which the actuator projects assure that the motor M will be turned on reliably at an early time for easy power piercing of a can lid by cutter wheel 25**.

Referring now to FIGS. 6–8, motor M is normally interconnected with feed wheel 18 by means of a gear reduction drive linkage. The motor drives a rotary output shaft 46 which carries a pinion 47. Pinion 47 drives gear 48 which rotates with a smaller pinion 49 on a common shaft 50 supported on frame 10. Pinion 49 in turn normally mates with and drives a large gear 51 which has an integral cylindrical sleeve 52 projecting rearwardly therefrom. Sleeve 52 is reduced in diameter at its rearward portion and extends slidably through an opening in the rear wall of casing 11.

The shaft 19 on which feed wheel 18 is mounted fits through a central bore in the boss 23 and extends a considerable distance rearwardly of frame 10 as well as slightly forwardly thereof. Shaft 19 has an integral hexagonal fitting 55 on the rearward portion thereof. Fitting 55 fits closely in a hexagonal cavity **52*a* formed internally of sleeve 52 in order to connect shaft 19 for rotation with gear 51. Sleeve 52 is able to slide forwardly and rearwardly on fitting 55. A washer 56 is fit over shaft 19 and located between the rearward end of boss 23 and fitting 55**.

A compression spring 58 circumscribes sleeve 52 and acts to urge gear 51 forwardly at all times. The forward end of spring 58 bears against an enlarged flanged collar 59 which is integral with sleeve 52 at a location adjacent gear 51. The rearward end of spring 58 bears against the internal rearwall of casing 11. The action of spring 58 biases gear 51 forwardly to ordinarily maintain pinion 49 and gear 51 in engagement with one another, as shown in FIG. 6. In this position, motor M is connected to rotate feed wheel 18 through the reduction gear linkage.

It is sometimes necessary or desirable to rotate feed wheel 18 manually, such as when a source of electrical power is not available. The present invention provides a crank 62 (FIGS. 7 and 8) or this purpose. One end of crank 62 (which has handle **62*b* at its other end) is threaded at 62*a* in order to be threadedly engaged within a centrally formed bore 63 in sleeve 52. Bore 63 is internally threaded at its rearward portion and extends forwardly to the hexagonal cavity 52*a*. A cylindrical rod 64 is received in bore 63 for sliding movement. An enlarged collar 65 is located on crank 62 to the rear of the threads 62*a***.

With particular reference to FIGS. 8 and 9, a pawl lever 66 is mounted to switch housing **44*a* for pivotal movement about a pivot coupling 67. Coupling 67 is to the left of center on the pawl lever 66 so that the weight of the lever tends to urge its right end downwardly to the position shown in FIG. 8. In this position, an upper flange portion 66*a* of the pawl is engaged between the teeth of gear 51 to prevent the gear from rotating counterclockwise (FIG. 8**) while permitting the normal clockwise driving of the gear.

In operation, the can opener is normally driven by motor M. Spring 58 maintains gear 51 in engagement with pinion 49 such that the motor is able to rotate feed wheel 18 upon depression of the rotary switch actuator 44. However, if electric power is unavailable or if it is otherwise desired to drive the feed wheel manually, crank 62 may be employed.

To utilize the crank, its threaded end **62*a* is received in bore 63 until collar 65 engages the rearward end of sleeve 52. As this occurs, the end of crank 62 bears against the end of rod 64 which is thereby slid forwardly against the rearward end of fitting 55. This action combined with the threading advancement of crank 62 into bore 63 causes sleeve 52 to slide rearwardly on fitting 55, resulting in disengagement of gear 51 from pinion 49. When crank 62 has been fully threaded into sleeve 52 with its collar 65 against the sleeve, gear 51 is completely out of engagement with pinion 49 as shown in FIG. 7. After this has occurred, rotation of crank 62 clockwise (as viewed in FIG. 8) rotates feed wheel 18 in the same direction (counterclockwise as viewed in FIG. 1). Motor M remains disengaged from the drive linkage due to the disengagement of gear 51 from pinion 49**.

Crank 62 may be threadably moved out of sleeve 52 by rotating it counterclockwise (FIG. 8). As the crank is removed, the forward force against rod 64 is released, and spring 58 pushes gear 51 forwardly into engagement with pinion 49. When the crank has been fully removed, gear 51 is automatically returned by spring 58 to the position of FIG. 6 wherein motor M is again drivingly connected with feed wheel 18 through the reduction gearing.

During the threading of crank 62 out of bore 63, gear 51 tends to be rotated counterclockwise (FIG. 8). However, pawl lever 66 acts to prevent gear 51 from rotating in this direction and thus prevents the shaft 46 of motor M from being manually rotated to possibly damage the motor. Rotation of gear 51 counterclockwise by the crank is prevented by the engagement of flange **66*a*** with the teeth of the gear, and the crank may thus be easily removed.

To open a can, lever 12 is swung upwardly from the solid line position of FIG. 1 to separate cutter wheel 25 from feed wheel 18. The can is then inserted with its flange or rim on top of the feed wheel, and lever 12 is swung downwardly to puncture the lid of the can with cutter wheel 25. Downward swinging of the lever causes its flange 45 to depress switch actuator 44 which energizes motor M and begins rotation of feed wheel 18.

Downward swinging of lever 12 also carries tab 40 against the inclined right edge of boss 42 and against pin 41. The round outwardly projecting surface of pin 41 cams tab 40 to the right (FIG. 1) and thus slides plate 24 to the right relative to lever 12. Once tab 40 has been moved downwardly far enough to engage the underside portion of pin 41, it is pulled to the left along the rounded surface of the pin due to the leftward force exerted on plate 24 by the engagement of cutter wheel 25 with the lid of the can. This pulls tab 40 to the left along the underside of pin 41 until the tab becomes engaged against the stop surface **42*a* of boss 42. As the can lid is being sheared, the operating thrust resulting from the resistance of the end of the can to being sheared by cutter wheel 25 maintains a leftward force on tab 40 that is greater than the upward force thereon. Accordingly, the tab (40) remains engaged against the underside of pin 41 and surface 42*a*, and lever 12 is thereby retained against actuator 44** to maintain the motor in its energized condition as the can lid is being sheared.

However, once the can lid has been completely sheared and the operating thrust is no longer present, the upward forces exerted on the hand lever assembly by the resilient can guide 35 and the upwardly biased actuator 44 predominate. Consequently, tab 40 is forced upwardly and to the right along pin 41 until it is disengaged from the underside thereof. This movement of the tab is permitted because of the sliding connection of plate 24 to lever 12. Release of tab 40 from pin 41 frees lever 12, which is forced upwardly to release actuator 44 as a result of the upward forces exerted by can guide 35 and actuator 44. Actuator 44 thus returns to its extended position to automatically deenergize motor M upon completion of the can shearing. Lever 12 is moved upwardly to the position shown in solid lines in FIG. 1, and the can is held in the can opener between feed wheel 18 and cutter wheel 25.

When crank 62 is employed to drive feed wheel 18, motor M is disengaged from the drive train. Otherwise, the operation of the can opener in shearing the lid of the can occurs in substantially the same manner as described.

From the foregoing, it will be seen that this invention is one well adapted to attain all of the ends and objects herein set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. In a can opener having an upright frame, a can feed wheel supported for rotation on said frame, and power means for rotating said feed wheel, the combination therewith of:

a hand lever mounted for pivotal movement on said frame;

a plate coupled with said hand lever for limited movement relative thereto;

a cutting element for shearing a can, said cutting element being carried on said plate for movement therewith into and out of can shearing position in response to pivotal movement of said hand lever;

a switch mechanism for energizing and deenergizing said power means, said switch mechanism being engageable by said hand lever to energize said power means;

a catch member on said frame; and a projection extending from said plate and engageable with said catch member to retain said cutting element in can shearing position and to retain said hand lever against said switch mechanism during shearing of a can, said projection automatically releasing from said catch member upon completion of the shearing of the can to release said hand lever from said switch mechanism and to thereby effect deenergization of said power means.

2. The combination of claim 1, wherein said catch member includes a hardened steel pin member.

3. The combination of claim 1, wherein said catch member has a curved surface against which said projection is cammed during release therefrom.

4. The combination of claim 1, wherein said plate is mounted on the forward surface of said hand lever for linear sliding movement thereon, said plate and hand lever cooperating to limit the relative sliding movement therebetween.

5. In a can opener having an upright frame presenting an aperture therein, a can feed wheel supported for rotation on said frame at a location forwardly thereof, and means for rotating said feed wheel, the combination therewith of:

a hand lever;

a pin member extending from said hand lever and insertable in said frame aperture to mount said lever for pivotal movement on the frame;

a cutting element coupled to said hand lever for movement therewith toward and away from said feed wheel;

a latch supported on said frame and having a latching surface spaced forwardly of the frame at a location substantially between said feed wheel and frame; and an edge portion of said hand lever located in a substantially common plane with the remainder of the hand lever, said edge portion being received between said frame and latching surface and remaining therebetween throughout a substantial pivot arc of said lever to retain said pin member in said aperture, said edge portion withdrawing from between said frame and latching surface upon pivotal movement of said lever beyond said pivot arc.

6. The combination of claim 5, wherein said edge portion is countoured to present a recessed edge curved in shape to disengage from said latching surface upon pivotal movement of said hand lever beyond said pivot arc.

7. The combination of claim 6, wherein said latching surface has an arcuate periphery and said recessed edge is shaped arcuately in substantial correspondence with the shape of said arcuate periphery.

8. The combination of claim 5, wherein the can opener includes a shaft carrying said feed wheel thereon and supported for rotation on the frame under the influence of said rotating means, said latch being mounted on said shaft at a location between said frame and feed wheel with said latching surface arranged arcuately about the axis of said shaft.

9. A can opener comprising:

an upright frame;

cutting means for shearing a can;

a feed wheel supported for rotation on said frame to feed a can relative to said cutting means;

a motor;

drive linkage drivingly coupling said motor to said feed wheel, said drive linkage being disengageable to uncouple said motor from said feed wheel;

a manual crank member;

means for coupling said crank member to said feed wheel to manually drive the latter; and means for disengaging said drive linkage to automatically uncouple said motor from said feed wheel in response to coupling of said crank member to said feed wheel.

10. A can opener as set forth in claim 9, including yieldable means for biasing said drive linkage against disengagement.

11. A can opener as set forth in claim 9, wherein said coupling means includes a threaded connection for said crank member to couple same to said feed wheel, and including means for preventing rotation of said feed wheel in a preselected direction during removal of said crank member from said threaded connection.

12. A can opener as set forth in claim 11, wherein said disengaging means operates to uncouple said motor from said feed wheel in response to threading of said crank member into said threaded connection.

13. A can opener as set forth in claim 11, including biasing means for engaging said drive linkage to couple said motor to said feed wheel in response to removal of said crank member from said threaded connection.

14. A can opener as set forth in claim 9, wherein said drive linkage includes:

a shaft supported for rotation on said frame and carrying said feed wheel thereon;

a first gear coupled with said shaft to effect rotation thereof; and a second gear, said motor being drivingly coupled to said second gear, said first and second gears being engageable to drivingly couple said motor to said shaft and disengageable to uncouple said motor from said shaft.

15. A can opener as set forth in claim 14, including yieldable means for biasing said first and second gears toward engagement with one another.

16. A can opener as set forth in claim 14, including means for preventing rotation of said first gear in a preselected direction during uncoupling of said crank member from said feed wheel.

17. A can opener comprising:

an upright frame;

cutting means for shearing a can;

a feed wheel supported for rotation on said frame to feed a can relative to said cutting means;

a motor;

drive linkage drivingly coupling said motor to said feed wheel, said drive linkage being disengageable to uncouple said motor from said feed wheel;

yieldable means for biasing said drive linkage against disengagement;

a manual crank member;

means for coupling said crank member to said feed wheel to manually drive the latter; and means for disengaging said drive linkage to uncouple said motor from said feed wheel when said crank member is coupled thereto.

18. A can opener comprising:

an upright frame;

cutting means for shearing a can;

a feed wheel supported for rotation on said frame to feed a can relative to said cutting means;

a motor;

drive linkage drivingly coupling said motor to said feed wheel, said drive linkage being disengageable to uncouple said motor from said feed wheel;

a manual crank member;

means providing a threaded connection for said crank member operatively coupling same with said feed wheel for manual driving of the latter;

means for preventing rotation of said feed wheel in a preselected direction during removal of said crank member from said threaded connection; and means for disengaging said drive linkage to uncouple said motor from said feed wheel when said crank member is threadadly coupled with said threaded connection.

19. A can opener as set forth in claim 18, including biasing means for engaging said drive linkage to couple said motor to said feed wheel in response to removal of said crank member from said threaded connection.

20. A can opener comprising:

an upright frame;

cutting means for shearing a can;

a feed wheel supported for rotation on said frame to feed a can relative to said cutting means;

a motor;

a shaft supported for rotation on said frame and carrying said feed wheel thereon;

a first gear coupled with said shaft to effect rotation thereof;

a second gear, said motor being drivingly coupled to said second gear, said first and second gears being engageable to drivingly couple said motor and said shaft and disengageable to uncouple said motor from said shaft;

a manual crank member;

means for coupling said crank member to said shaft to manually drive the feed wheel; and means for disengaging said first and second gears to uncouple said motor from said shaft when said crank member is coupled thereto.

21. A can opener as set forth in claim 20, including yieldable means for biasing said first and second gears toward engagement with one another.

22. A can opener as set forth in claim 20, including means for preventing rotation of said first gear in a preselected direction during uncoupling of said crank member from said shaft.

* * * * *